United States Patent [19]

Niekrasz et al.

[11] Patent Number: 4,641,461

[45] Date of Patent: Feb. 10, 1987

[54] SLIDING DOOR ASSEMBLY

[75] Inventors: Francis M. Niekrasz, Palos Park; Melvin C. Kasper, La Grange Park; Gerald J. Bockwinkel, Mundelein, all of Ill.

[73] Assignee: Ardco, Inc., Chicago, Ill.

[21] Appl. No.: 704,395

[22] Filed: Feb. 22, 1985

[51] Int. Cl.[4] ..... E05D 15/06

[52] U.S. Cl. ..... 49/404; 16/74

[58] Field of Search ..... 49/404, 425, 505; 16/71, 74, 78

[56] References Cited

U.S. PATENT DOCUMENTS

| | | | |
|---|---|---|---|
| 3,584,417 | 6/1971 | Gatton et al. | 49/404 |
| 3,978,617 | 9/1976 | Eventoff | 49/404 |
| 4,523,408 | 6/1985 | McConnell | 49/505 X |

*Primary Examiner*—Kenneth Downey

*Attorney, Agent, or Firm*—Leydig, Voit & Mayer

[57] ABSTRACT

A door assembly describing a stationary frame having doors mounted therein for relative translational movement. Each door includes a self-closing mechanism comprising a flexible tubular member affixed at one end to the frame and a follower secured to the other end of the tubular member for loose positioning in an active position adjacent a side of the door for urging the door in a closed position, and a self-opening means comprising a similar flexible tubular member affixed at one end to the frame and a follower secured to the other for loose positioning in an active position adjacent an opposite side of the door for urging the door to a fully open position. The self-closing and self-opening mechanisms both are adapted to be deactivated as an incident to positioning the door to respective locations within the mounting frame. The illustrated frame includes two telescopic inner fitting frame members that are adapted for mounting on variable thickness cabinet walls and which provide an inherent thermal barrier between the cabinet wall and the doors of the assembly.

5 Claims, 25 Drawing Figures

FIG. 10
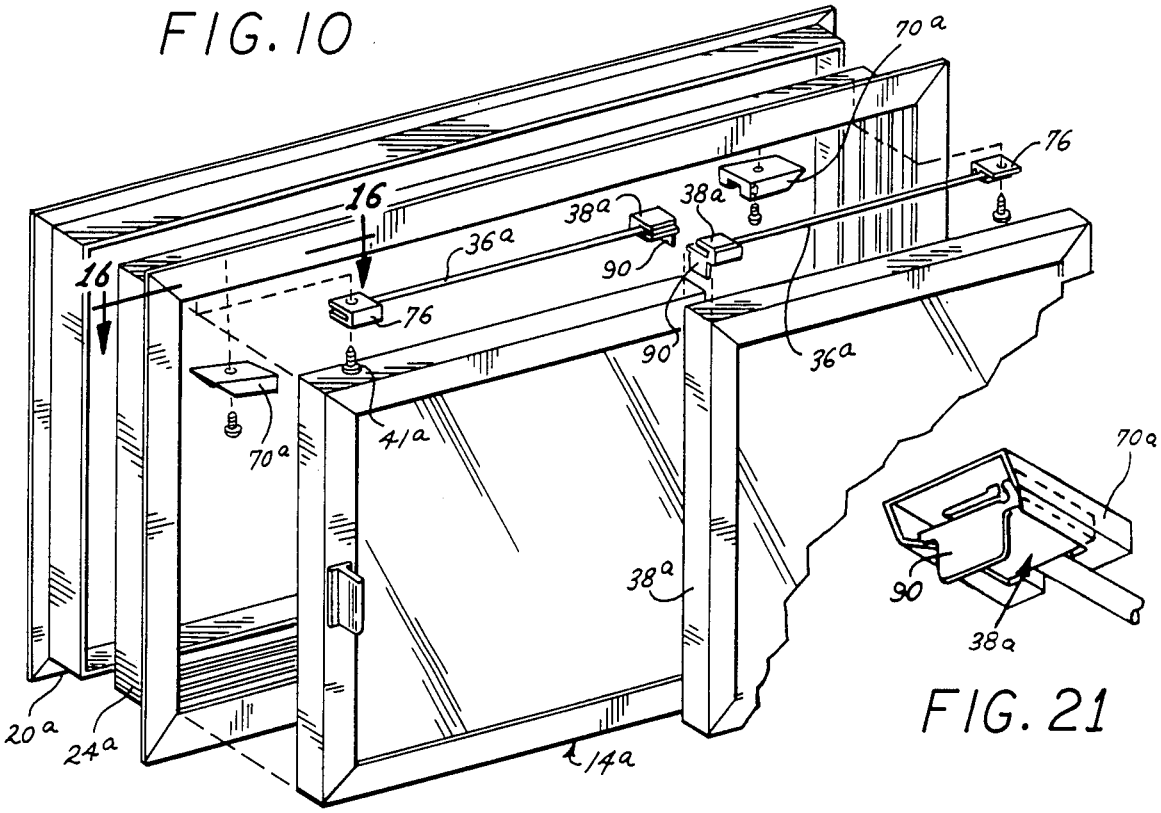
FIG. 21
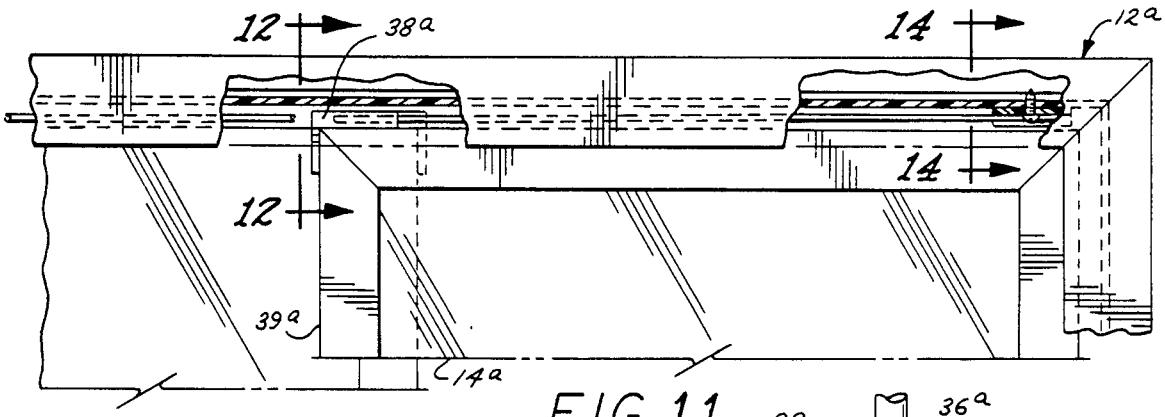
FIG. 11
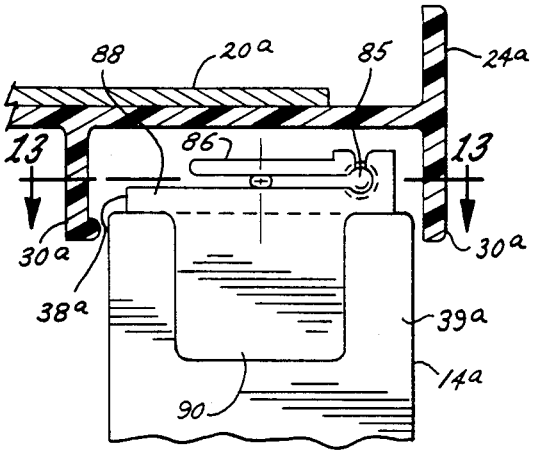
FIG. 12
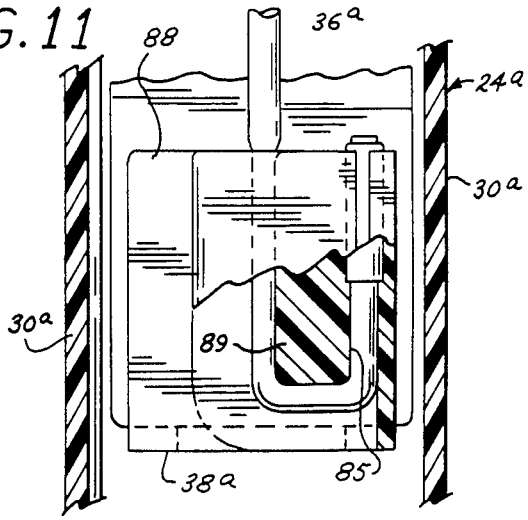
FIG. 13

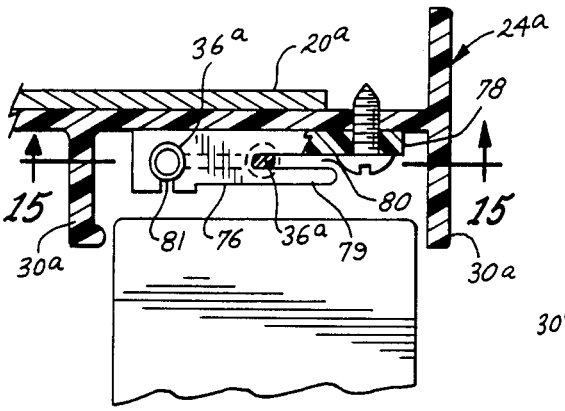
FIG. 14
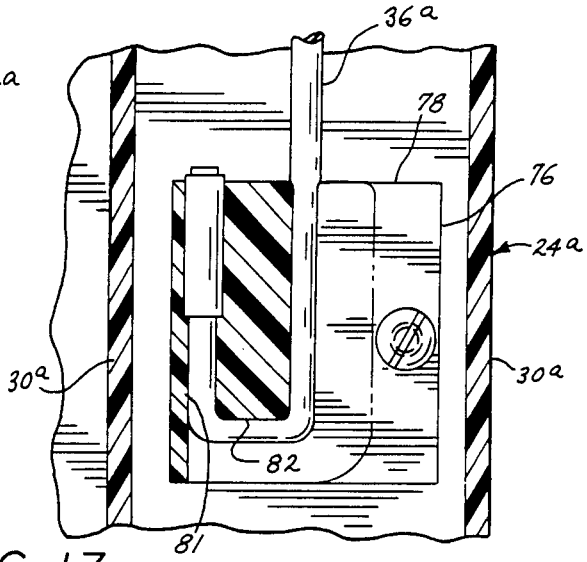
FIG. 13
FIG. 20
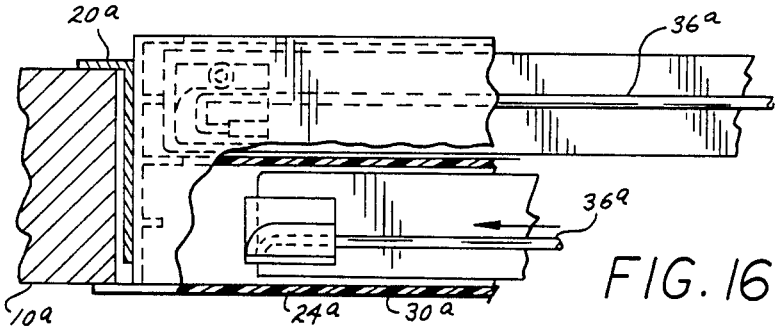
FIG. 16
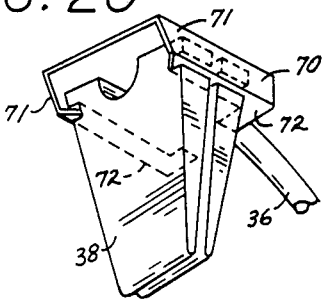
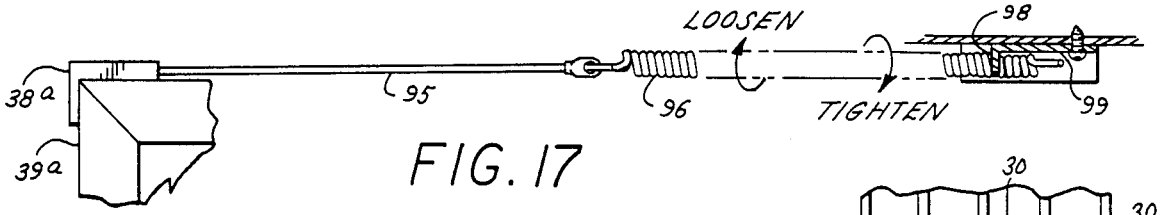
FIG. 17
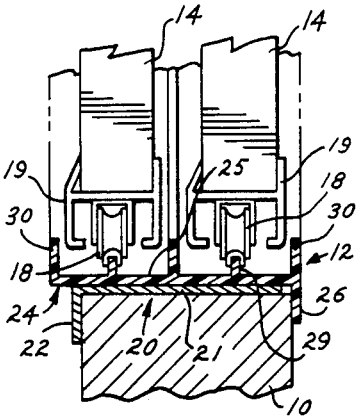
FIG. 18a
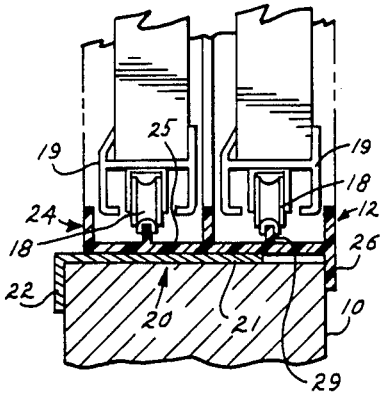
FIG. 18b
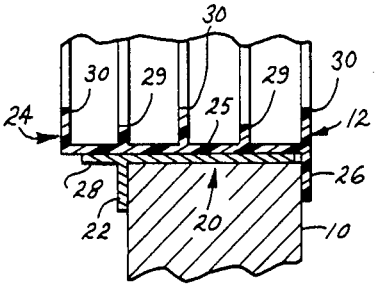
FIG. 19a
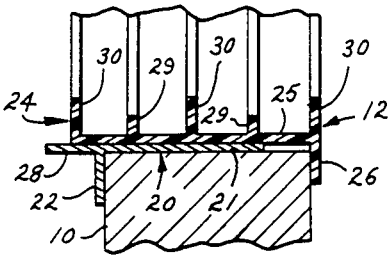
FIG. 19b

SLIDING DOOR ASSEMBLY

DESCRIPTION OF THE INVENTION

The present invention relates generally to door assemblies, and more particularly to sliding door assemblies for refrigerators and freezers which are frequently opened and closed as an incident to obtaining access to the refrigerated zone.

Commercial refrigerators commonly are used in deli bars and the like for containing various food items for customer selection. The customer views the food selections through a glass window from one side of the refrigerated cabinet and sliding glass doors are provided on the opposite side of the cabinet to permit access thereto by the store clerk. During the course of the day in filling customer orders, the doors are opened and shut on numerous occasions and food frequently is dropped into the bottom of the cabinet and into the track for the sliding doors. As a result, it is customary in such deli bars to remove the doors at the end of each day to permit effective cleaning of the doors and the interior of the cabinet.

Because of the somewhat conflicting needs for energy efficiency, ease of access to the refrigerated area, and convenience in door removal and cleaning, the sliding door assemblies for such refrigerators have been a continual source of problems. For example, because the store clerk usually has his hands occupied when removing food from the refrigerated zone, it is not easy to completely close the sliding doors after use, and as a result, the doors often are left partially open. During the course of the day, this can greatly increase the heat loss to the refrigerated zone, and thus significantly increase the operating cost for the refrigerator.

While self door closure mechanisms have been available for such sliding doors which insure that the doors are closed after use, such door closure mechanisms have created other problems. Since the door tends to be constantly pulled to their closed position, it can be difficult for the store clerk to remove food, while at the same time holding the doors open. Such door closure mechanisms similarly hamper loading of the refrigerator. Conventional self door closure mechanisms have further impeded easy removal of the doors for cleaning of the refrigerator, frequently necessitating cumbersome disassembly and reassembly of the mechanism. Hence, notwithstanding energy efficiency considerations, self door closure mechanisms often have not been used in deli bars or like refrigerators which require frequent attendant or customer access.

It is an object of the present invention to provide an improved energy efficient sliding door assembly for refrigerators, freezers, and the like that permits easier use and maintenance.

Another object is to provide a sliding door assembly as characterized above in which the sliding doors have self-closing means, but do not require a user obtaining access to the refrigerated zone to manually hold the doors in an open position against the action of the self-closing mechanism.

A further object is to provide a sliding door assembly in which the sliding doors have self-closing means that permit easy removal of the doors from the cabinet for cleaning and maintenance. A related object is to provide such a sliding door assembly in which the doors may be removed without cumbersome handling or removal of the self-closing mechanism.

Still another object is to provide a sliding door assembly with self door opening means that assists in completely opening a door and maintains the door in such open condition during access to the refrigerated zone.

Yet another object is to provide a sliding door assembly having self door closure means that is rendered operative at a predetermined position to complete closing of the door and maintain it in a fully closed condition and self-opening means that is also rendered operative at a predetermined position to complete opening of the door and to maintain it in such open condition.

Still a further object is to provide a refrigerator or freezer sliding door assembly with a relatively inexpensive, versatile, energy efficient mounting frame. A related object is to provide such a mounting frame that is adapted for reliable mounting in cabinet walls of different thicknesses and which provides a thermal barrier between the refrigerator cabinet wall and the sliding door.

Other objects and advantages of the invention will become apparent upon reading the following detailed description and upon reference to the drawings, in which.

Figure 5A:
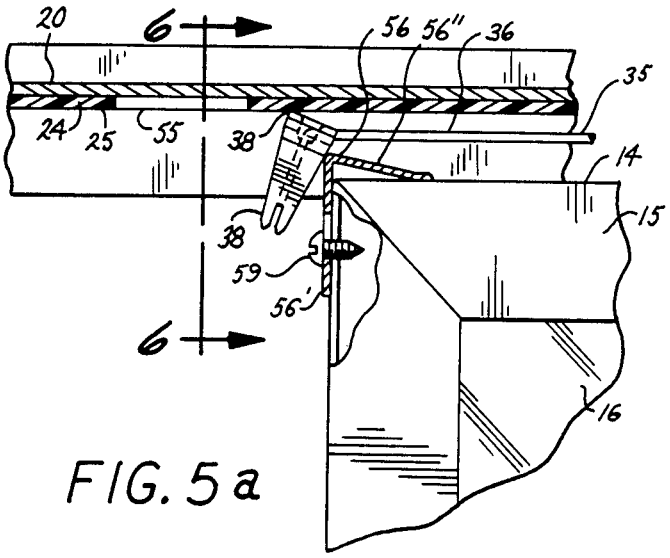
Figure 6:
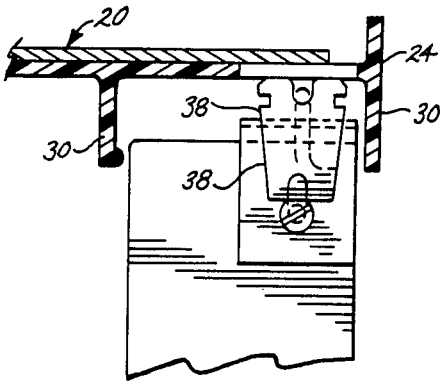
Figure 5B:
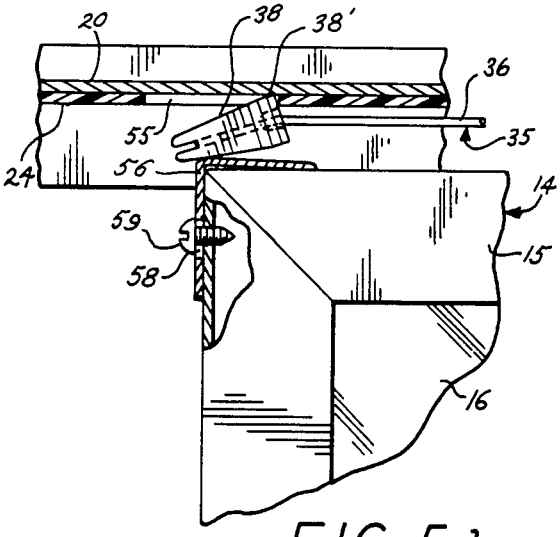
Figure 5C:
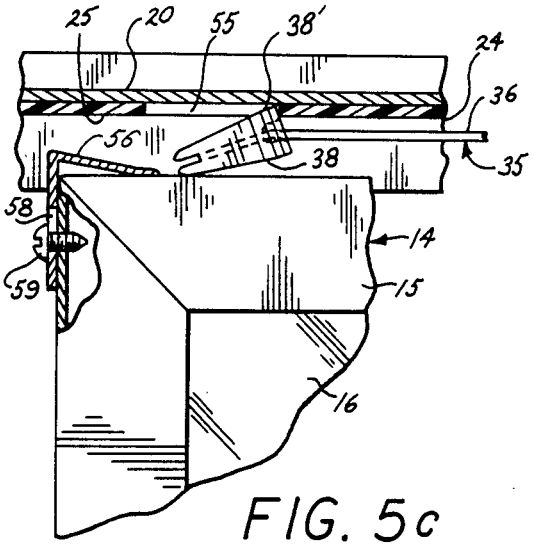

FIGS. 5*a–c* are sequential views showing the self-closing mechanism being moved from an active to an inactive position;

FIG. 6 is an end view of the sliding door with the self-closure mechanism in an active position, taken in the plane of line 6—6 in FIG. 5*a;*

Figure 7:
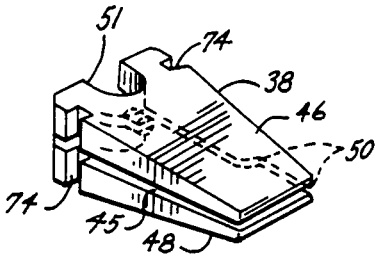
Figure 8:
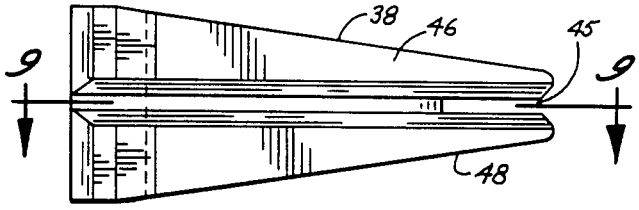
Figure 9:
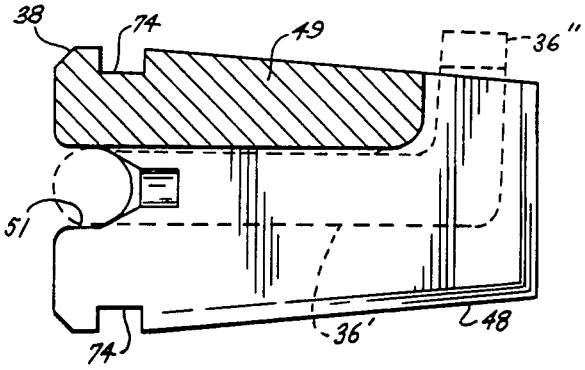

FIG. 7 is a perspective of the follower of the illustrated self-closing mechanism;

FIG. 8 is an enlarged side elevational view of the follower shown in FIG. 7;

FIG. 9 an enlarged horizontal section of the illustrated follower, taken in the plane of line 9—9 in FIG. 8;

FIG. 10 is an exploded view of a sliding door assembly having an alternative form self-closure mechanism;

FIG. 11 is an enlarged partial side elevation view of the sliding door assembly shown in FIG. 10 with the sliding doors shown in their closed position under the influence of the door closure mechanisms;

FIG. 12 is an enlarged end view of one of the sliding doors showing the the self-closure mechanism acting thereon, taken in a plane of line 12—12 in FIG. 11;

FIG. 13 is an enlarged horizontal section taken in the plane of line 13—13 in FIG. 12;

FIG. 14 is an enlarged vertical section taken in the plane of line 14—14 in FIG. 11;

FIG. 15 is an enlarged horizontal section taken in the plane of line 15—15 in FIG. 14;

FIG. 16 is a fragmentary, horizontal section showing the self-closure mechanism for one of the sliding doors in an active position;

FIG. 17 is an alternative form of self-closure mechanism, similar to the type shown in FIGS. 10–16;

FIG. 18*a* is an enlarged vertical section through the mounting frame and bottom track of the illustrated sliding door assemblies;

FIG. 18*b* is a vertical section, similar to FIG. 18*a*, showing the mounted frame on a cabinet wall of greater thickness;

FIG. 19*a* is a vertical section of an alternative form of sliding door assembly mounting frame;

FIG. 19*b* is a section, similar to FIG. 19*a*, but showing the mounting frame on a refrigerator cabinet wall of greater thickness.

FIG. 20 is a perspective view of one of the followers shown in FIG. 7 parked in a retaining bracket such as during removal or insertion of one of the sliding doors; and FIG. 21 is a perspective view of one of the followers shown in FIGS. 10–16 parked in a retaining bracket such as during removal or insertion of one of the sliding doors.

While the invention is susceptible of various modifications and alternative constructions, certain preferred embodiments have been shown in the drawings and will be described below in detail. It should be understood, however, that there is no intention to limit the invention to the specific forms described but, on the contrary, the intention is to cover all modifications, alternative constructions and equivalents falling within the scope of the invention.

Referring now more particularly to the drawings, there is shown a refrigerated display cabinet or compartment wall 10 having mounted therein a sliding glass door assembly 11 embodying the present invention. It will be understood that the wall may be the exterior wall for any type of refrigerator or freezer cabinet or compartment and that the sliding glass door assembly is provided in a suitable opening in the wall for enabling access into the refrigerated zone. The sliding door assembly 11 comprises a stationary mounting frame 12 having in this case two sliding doors 14 mounted therein. The doors 14 are of similar construction, except that one door opens to the right, while the other door opens to the left in a customary manner.

Each of the illustrated doors 14 may be of a known type comprising a metal border frame 15 in which a transparent panel 16 is mounted so that merchandise within the refrigerated zone may be visible therethrough. The transparent panel 16 of each door may be made of glass, and preferably comprises two parallel panes with a dead air insulating air space therebetween. To support the doors 14 for rolling movement within the stationary frame 12, a plurality of anti-friction rollers 18 are rotatably mounted on the underside of each door in a known manner. (FIG. 18) Protective flanges 19 in this instance depend from opposed sides of the lower border frame 16 to provide a partial enclosure within which the rollers are disposed.

Figure 1:
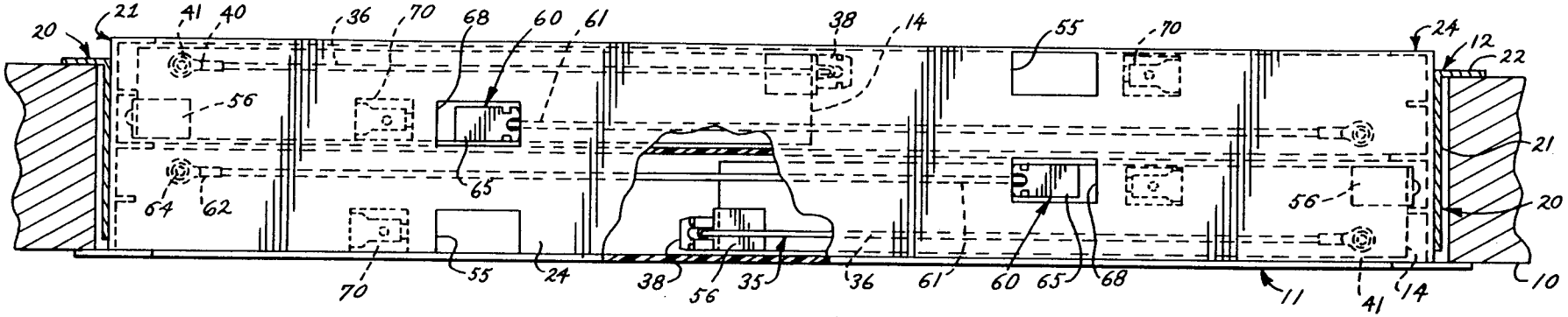
FIG. 1 is top plan view, in partial section, of a refrigerator cabinet wall having a sliding door assembly and mounting frame embodying the present invention.

In accordance with one aspect of the invention, the stationary door frame comprises a two part telescoping assembly that accommodates cabinet walls of various thicknesses and which provides a thermal barrier between the cold wall of the refrigerator cabinet and the doors of the assembly. The illustrated frame 12 includes an outer rectangular frame member 20, preferably formed of a rigid material such as aluminum, with each side having a mounting flange 21 for positioning against an end face of the opening in the cabinet wall 10 and a vertical flange 22 that is positionable against one side of the cabinet wall. (FIG. 18) The frame 12 further includes a inner frame member 24, preferably formed of a plastic material such as polyvinylchloride, which includes a mounting flange 25 that is positionable in telescopic adjustable relation within the outer frame member 20 and a vertical flange 26 that is positionable against a side of the cabinet wall opposite the side against which the vertical flange 24 of the outer frame member 20 is positioned. The telescopic relation between the inner and outer frame members 20, 24 permits the respective vertical flanges 22, 26 to be firmly positioned flush with opposed sides of the cabinet wall 10 regardless of slight variances in the thickness of the cabinet wall upon which the frame is mounted. For example, as illustrated in FIGS. 1 and 18*a*, the inner and outer members 20, 24 are mounted with a relatively small space between the end of the flange 24 of the outer frame member and the side flange 26 of the outer frame member. For purposes of illustration, FIG. 18*b* shows the same frame members 20, 24 mounted on a substantially wider cabinet wall 10. While in that instance a substantially greater space exits between the end of the mounting flange 21 and the side flange 26, the mounting flange 21 of the inner frame member 20 still provides ample bearing support for the inner frame member 24 and the doors 14 mounted therein.

An alternative form outer frame member 20 is illustrated in FIG. 19*a* which is adapted for mounting on relatively narrow thickness cabinet walls. In this case, the outer frame member 20 includes a flange portion 28 extending outwardly beyond the side flange member 22 so as to provide added support for the inner frame member 24, and the doors mounted therein, which extend outwardly beyond the side of the cabinet wall 10. FIG. 19*a* shows the frame members 20, 24 mounted on a relatively narrow cabinet wall 10, while 19*b* shows a somewhat thicker cabinet wall, but still considerably less than the thickness of the inner frame member 24. In both instances, the telescopic, adjustable fitting of the inner and outer frame members 20, 24 permits firm, reliable mounting of the frame in the opening of the cabinet wall with the inner and outer flanges 22, 26 flush with the opposed sides of the cabinet wall.

It will be appreciated that in the door mounting frames 12 illustrated in both FIGS. 18 and 19 the plastic inner frame member 24 provides an inherent thermal barrier between the cabinet wall and the sliding doors mounted within the frame. The outer frame member 20, preferably being made of metal, provides relatively strong rigidity for the frame. Alternatively, the outer frame member 20 could be made of a relatively rigid plastic material.

For the purpose of supporting the rollers 18 of the doors 14 for sliding movement relative to the frame 12, the inner frame member 24 is provided with a pair of integrally formed parallel tracks 29 which respectively receive the rollers 18 of the doors. Each of the illustrated tracks 29 is in the form of a flange projecting upwardly from the mounting flange 25 for the bottom length of the inner frame member 24. Each roller 18 is formed with a peripheral groove or channel adapted to retain the rollers on the tracks 29. The mounting flange 25 of the inner frame member 24 in this case also has a plurality of integrally formed upstanding flanges 30 which further define the track area within which the doors 14 move. The vertical sides of the inner frame member 24 in this instance are formed with similar tracks and flanges 29, 30, while the upper horizontal portion of the inner frame member 24 is similarly formed, but without the tracks 29.

In accordance with another aspect of the invention, each of the sliding doors has a respective self-closing mechanism which is of relatively simple and reliable construction, and which permits easy removal and replacement of the doors without cumbersome handling or disassembly of the mechanism. To this end, each of the sliding doors 14 has a respective self-closing mechanism 35 which is made of rubber latex or other stretchable resilient material, which is fixed at one end to the frame 12 above the door and the other end has secured thereto a follower 38 that is removably positionable adjacent a leading side 39 of the door for urging it in an opposite closing direction. The flexible tube 36 in this instance is fixed to a bracket 40 that in turn is secured to the frame 12 by a screw 41.

The follower 38 preferably has a wedge-shaped configuration, when viewed from the end as shown in FIGS. 1 and 5*a-c*, with the narrow end of the wedge extending in depending fashion when the follower is in its normal active position against the leading side 39 of the sliding door, as shown in FIG. 5*a*. For securing the flexible tube 36 to the follower 38, the follower in this case is formed with a relatively narrow transverse slot 45 that extends through the follower to define two substantially flat sections 46, 48 that are retained in closely spaced relation by an elongated central portion 49 (FIGS. 8 and 9). To secure the flexible tube 36 in place, the end of the tube is stretched, then forced through the slot 45 between the flat sections 46, 48 such that section 36, (FIG. 9) of the tube is longitudinally disposed against the elongated central portion 49 and the end of the tube is then bent about the lower most end of the connecting portion 49, with the extra or terminal end section 36″ extending transversely out beyond the follower, as shown in phantom in FIG. 9. At such exit point, the follower 38 is formed with relatively small gripping flanges 50 (FIG. 7) that positively engage the end of the tube. The terminal section 36″ of the tube extending outwardly from the follower may thereupon be cut off. The upper end of the follower 38 in this instance is formed with a recess 51 through which an outwardly extending portion of the tube makes a substantially 90° bend when the follower is in the active condition, as shown in FIG. 5*a*.

Figure 2:
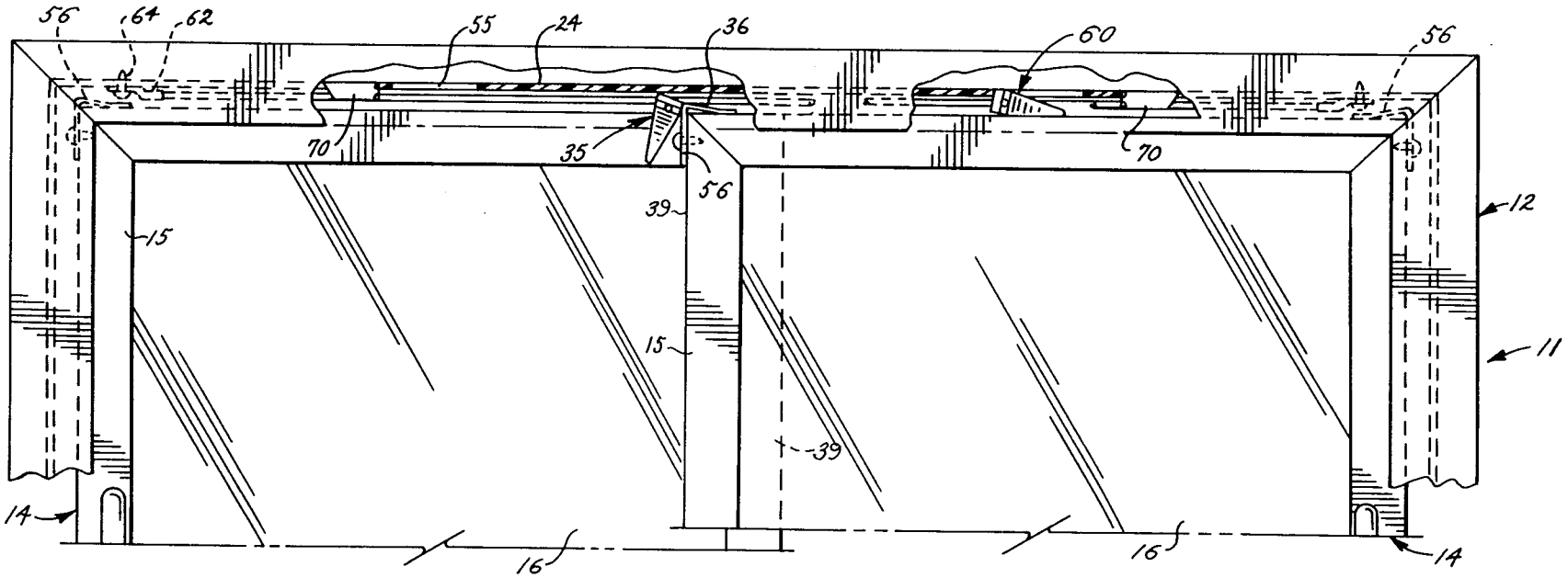
FIG. 2 is a partial front elevational view of the sliding door assembly and frame shown in FIG. 1, with the sliding doors thereof shown in a closed position under the influence of self-closing mechanisms according to the present invention.
Figure 3:
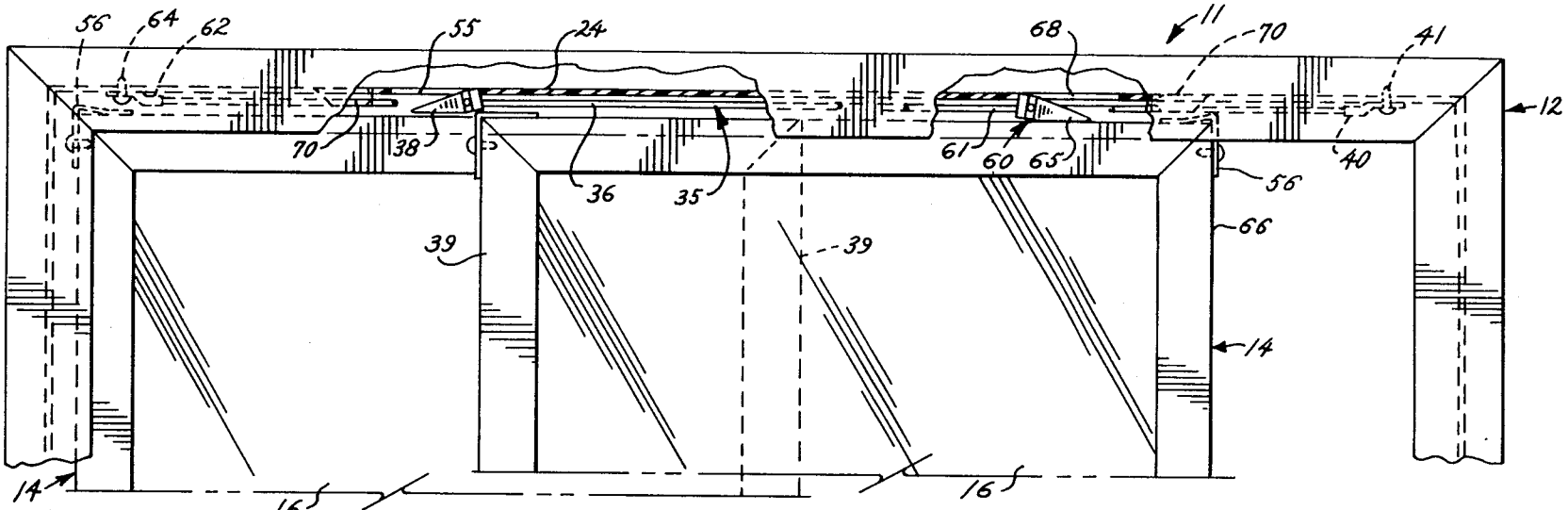
FIG. 3 is a side elevational view, similar to FIG. 2, but showing one of the sliding doors opened to a predetermined position which deactivates the self-closing mechanism.
Figure 4:
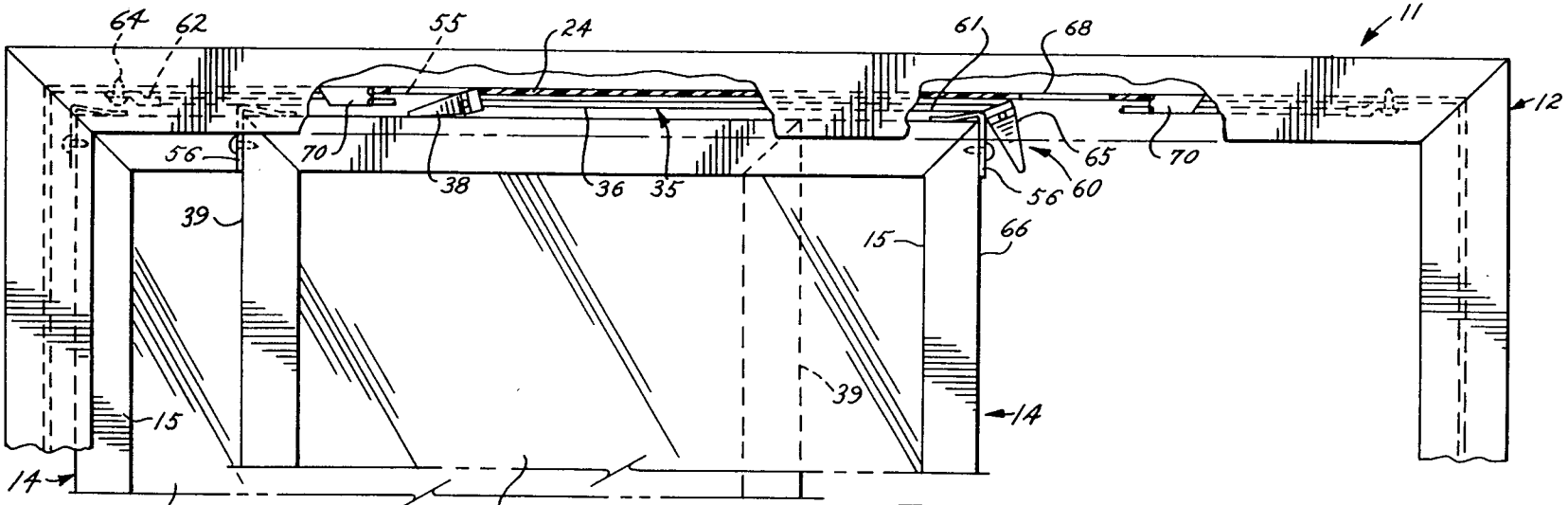
FIG. 4 is a front elevational view, similar to FIGS. 2 and 3, showing one of the sliding glass doors open to a position for activating a self-opening mechanism according, to the present invention.

Upon relaxation of the stretching force on the tube after it is inserted into the slot 45 between the follower sections 46, 48 the tube will expand into tight fitting relation in the slot 45 and will be retained therein without the necessity for auxiliary fasteners. It will be appreciated that by securing the follower 38 to the flexible tube 36 in such fashion, the follower may be selectively positioned along the length of the tube such that the tube will have has the desired tension when in the active door closing position, such as shown in FIG. 2. As the door 14 is moved away from such closed position, as shown in FIG. 3, the follower 38 moves with the leading side 39 of the door further stretching the tube, and thereby providing an increasingly greater closing force to be exerted on the door as it is opened.

In keeping with an important aspect of the invention, means are provided for deactivating the door closure mechanism when the door is opened to a predetermined position so as to allow unencumbered access through the doorway without the door continually being drawn toward its closed position. In the illustrated embodiment, the top section of the inner frame member 24 is formed with a recess or slot 55 at a predetermined location along the path of travel of the door so that upon movement of the leading side 39 of the door 14 to such location, the follower 38 will automatically pivot into a substantially horizontal, inactive position partially in the recess 55 so that the door may pass beyond such point without the self-closing mechanism 35 acting on the door. More specifically, as the follower 38 reaches the recess 55, a leading corner 38′ of the follower tends to be pulled into the slot 55 by the force of the tube 36 acting thereon, raising the level of the follower 38 to a point that the continued opening movement of the door 14, as shown in FIG. 5*b*, tends to pivot the follower into the inactive, generally horizontal condition.

In order to allow for variations in the clearance between the upper side of the door 14 and the underside of the frame 20, and to allow for the door 14 to more easily pass by the follower 38 as it is inactivated, each door 14 has a flexible corner in the form of a generally L-shaped spring 56. The spring 56 has a depending leg 56′ that is mounted for relative vertical movement on the leading side 39 of the door 14 and is bent at a normal angle of slightly less than 9° with the upper leg 56″ thereof loosely disposed adjacent the top side of the door. The spring 56 thereby has a corner that normally extends a slight distance above the top of the door, as shown in FIG. 5*a*, which serves as an extension of the corner of the door. The depending leg 56′ of the spring is formed with a slot 56′ to permit vertical sliding movement of the leg relative to the leading side 39 of the door and a mounting screw 59 that retains it in place. As the door is moved from its closed position shown in FIG. 2, the corner of the spring 56 engages the side of the follower 38 to move the follower along with the door, further stretching the flexible tube 36 as the door proceeds. Upon reaching the deactivating slot 55 in the door frame, as shown in FIG. 5*b*, the follower 38 is pivoted by virtue of the pulling force of the flexible tube 36 on the upper end thereof and the counteracting force of the corner of the spring 56 at a lower point on the follower, causing the follower to assume a substantially horizontal inactive position partially within the slot. (FIG. 5*b*) As the side 39 of the door 14 passes under the follower, as shown in FIG. 5*b*, the corner of the spring 56 is forced downwardly spreading the legs 56′, 56″ thereof such that they more closely approach an angle of 90°, and thus, fit more squarely on the corner of the door, thereby permitting the door to pass beyond the deactivated follower. Upon closure the door 14, it will be seen that as the side 39 of the door again passes the slot 56, from the position shown in FIG. 5*c* to that shown in FIGS. 5*a* and 5*b*, the follower 38 again is automatically pivoted to its active position under the opposed forces of the flexible tube 36 and corner spring 56 acting on it.

It will be appreciated by one skilled in the art that the follower deactivation slot 55 may be located at any desired location along the path of travel of the sliding door for the particular usage. For example, the slot may be located so that the self-closing mechanism 35 is deactivated when the door is open only a few inches, thereby allowing a store clerk to reach through the door without the door being urged in a closed direction. When the clerk has completed his work, and wishes to close the door, he need only push the door to the point where the self-closing mechanism is activated, which will thereupon assure that the door is firmly closed until the next time it is used. On the other hand, it may be desirable to locate the deactivation slot 55 at a point so that the self-closing mechanism 35 is active until the door is opened to a point just ahead of the fully opened position. At the extreme open position, the self-closing mechanism would become inactive and would not interfere with access through the doors, such as during loading or stocking of a refrigerated cooler. A short movement of the door toward the closing position would then activate the closure mechanism 35 and bring the door to a sure and firm closure until the next usage.

In keeping with still another aspect of the invention, the sliding doors 14 of the door assembly each have a respective self-opening mechanism 60 that is rendered active at a predetermined open position of the door for insuring that the door is brought to a fully opened position and maintained in such position. The self-opening mechanisms 60 each are substantially similar to the self-closing mechanisms 35, comprising a flexible tube 61 fixed at one end to the frame 20 by a bracket 62 and fastener 64 and having a follower 65, similar to that previously described, secured to the other end for engaging a trailing side 66 of the door when it is opened to the determined position. The follower 65 in this instance is normally received in a deactivation slot 68 in the inner frame member 24 so that it does not act upon the door. When the door is opened to a position such that a trailing side 66 of the door 14 passes under the follower 65 in the slot 68, the follower 65 will pivot downwardly into active position, in the manner previously described, thereupon activating the opening mechanism 60 so that the door is assuredly moved to a fully opened position. Upon closing of the door to such point, the follower 65 is automatically moved into deactivated position in the slots 68 in the manner previously indicated.

From the foregoing, it can be seen that the self-opening mechanism 60 is activated only when the door 14 is moved to a predetermined opened position and the self-closing mechanism 35 is activated only when the door is within a predetermined distance from its normally closed position. In the illustrated embodiment, the deactivation slots 55, 68 are located so that neither mechanism 35, 60 is activated when the door is located at a substantially centered position on its track. (FIG. 3) It will be understood, however, that by appropriately locating the slots 55 68 the door may be at all times under the control of either the door closing or door opening mechanisms.

To facilitate removal of the doors 14 for cleaning and full access to the cabinet or compartment with which they are used without the door closure and opening mechanisms 35, 60 acting on the doors, a retaining bracket 70 (See FIGS. 1-A and 20) is mounted on the underside of the frame for each of the mechanisms for holding the respective follower indefinitely in an inactive position. The retaining brackets 70 in this instance are channel-shaped, having a base portion which may be secured to the underside of the frame, such as with an appropriate fastening screw, and a pair of transversely, spaced depending side legs 71, each having inwardly directed flanges 72 at the lower end thereof. The end of the bracket which faces the mechanism to be retained is formed with transversely directed abutment flanges 73 such that the follower may be manually removed from the end of the door upon which it normally rides and pulled against the force of the flexible tube to a position beyond the retainer bracket 70, with the biasing force of the tube then being permitted to draw the retainer into the channel and against the abutment flanges 73, where the follower is positively held. The follower in this case is formed with channeled recesses 74 on its opposed sides which receive transverse flanges 72 as the follower is positioned into the retainer. With each of the opening and closing mechanisms deactivated in such manner, the doors may be readily lifted from their tracks and removed from the frame. Because the tubes are flexible in nature, they will experience slight collapsing if pressed between the top of the door and the underside of the frame during lifting of the door so as not to impede its removal.

Referring now to FIGS. 10–16, there is shown a sliding door assembly 11*a* with a modified type door closure mechanism 35*a*, wherein items similar to those described above have been given similar reference numerals with the distinguishing suffix "a" added. The door closure mechanism 35*a* in this case includes a flexible tube 36*a* similar to that previously described fixed at one end to the mounting frame 12*a* and having a follower 38*a* at the other end adapted for movement with the leading side 39*a* of the door so as to stretch the flexible tube 36*a* as the door is opened and thereby exert a closing force thereon. In this case, the door closure mechanisms 35*a* remain active at all times during normal use of the door 14.

For securing the end of the flexible tube 36*a* to the mounting frame 15*a*, a bracket 76 is provided which is adapted to releasably and adjustably receive the end of the tube. (FIGS. 14 and 15) The bracket 76 is fixed to the underside of the inner frame member 24*a* by a fastening screw 41*a* passing through a base plate 78 of the bracket. For retaining the tube 36*a* the bracket 76 includes a plate portion 79 disposed in closely spaced parallel relation to the base plate 78 so as to define a narrow slot 80. The bracket 76 further is formed with an elongated aperture 81 extending the length thereof having a relatively narrow entrance way thereto. To secure the tube 36*a* to bracket 76, the end of the tube is stretched, forced through the narrow passage into the elongated aperture 81, trained about the end of a central inner portion 82 of the bracket and forced through the slot defined between the plate portion 79 and the base plate 80 into position adjacent a longitudinal side of the central portion 82, as shown in FIG. 15. Upon relieving the tension in the end of the tube 36*a*, the tube will become tightly constrained in the bracket and will be reliably held in place without the necessity for auxiliary fastener means.

The follower 38*a* in this instance is adapted for similarly engaging the opposite end of the flexible tube, having an aperture 85 and plate portion 86 disposed in closely spaced relation to a base portion 88. (FIGS. 12 and 13) The end of the tube 36*a* is similarly stretched, forced through a constriction into the elongated aperture 85 trained about the end of an inner bracket portion 89, and forced between the plate portion 86 and base 88 into determined proper position adjacent an inner bracket portion 89. Upon relief of the tension in the tube, it again is positively secured to the follower 38*a* without auxiliary fasteners. The follower 38*a* and bracket 76 may be selectively positioned on the tube 36*a* so that the tube has a predetermined length for creating the desired biasing force on the door. The follower 38*a* in this case includes a door engaging flange 90 depending from the base plate 88 for riding on the leading side 39*a* of the door, causing the tube 36*a* to be stretched as the door is opened and to assuredly and firmly close the door upon release.

To facilitate removal of the doors for cleaning, a channel-shaped bracket 70*a* generally similar to that previously described, may be provided on the underside of the frame 12*a* to permit manual positioning of the follower 38*a* in a deactivated position. The flexible tube 36*a* again is at least partially collapsible to facilitate door removal.

To enhance the life of the door closure mechanism, and particularly in installations such as in the embodiment of FIGS. 10–16 where the door closure mechanism is not deactivated during normal opening of the door, and thus is repeatedly stretched to its maximum length, the door closure mechanism may alternatively be formed with a combination flexible latex tube 95 and spring coil 95, such as shown in FIG. 17, with the coil 96 having greater resiliency than the tubular member. During opening of the door, the majority of the flexing and extension will occur from the spring 96 with a lessor amount from the latex tube 95. Since the life of the latex tube 95 is a function of the extent of elongation and cycles of use, such a flexible connector for the follower is particularly adaptable for installations where the door is frequently opened and closed and where the follower is not deactivated. To further permit selective adjustment in the biasing force of the mechanism, the spring 96 in this case is mounted in a depending tab 98 of a support bracket 99 and by rotation of the spring 96 may be threadedly advanced through the tab to adjust the spring tension.

From the foregoing, it can be seen that the sliding door assembly of the present invention is particularly adapted for refrigerators, freezers and the like and permits easier use and maintenance, while facilitating energy conservation. The self-closing mechanisms permit easy removal of the doors without cumbersome handling or removal of the closure devices. When the need justifies, the self-closing mechanisms can be used in conjunction with door opening mechanisms to facilitate ease of access through the door opening, as well as insure reliable closing. The door opening and closing mechanisms both are of relatively simple construction and thus lend themselves to economical manufacture and use.

We claim as our invention:

1. A door assembly for mounting in the opening of a wall, comprising a stationary door frame, at least one movable door mounted within said frame for translational movement between a fully closed position and an open position, said frame comprising an outer frame member having a mounting flange for mounting on an end face of said wall opening and a vertical flange for positioning on one side of said wall, an inner frame member adapted for telescopic and adjustable mounting within said outer frame member and having a mounting flange positionable in close fitting relation to the mounting flange of said outer member and a vertical flange positionable adjacent a side of said wall opposite the side the vertical flange of said outer frame member is positioned, the bottom portion of said inner frame member having means for supporting said door for relative movement, self-moving means for said door including a flexible tubular member, means for affixing one end of said tubular member to said inner frame member, a follower secured to the other end of said tubular member for loose positioning in an active position adjacent a side of said door for urging said door in one direction of movement and follower retaining means mounted on the upper portion of said inner frame member, said follower being selectively removable from said active position adjacent the side of said door and manually positionable in an inactive position in said retaining means for permitting removal of said door from said frame without disassembly of said self-moving mechanism or removal thereof from said frame.

2. The door assembly of claim 1 in which said door supporting means comprises an integrally formed track for supporting said door for relative translational movement.

3. The door assembly of claim 2 in which said door has rollers for riding on said track.

4. The door assembly of claim 1 in which said inner and outer frame members are mountable in the opening of said wall with a spacial separation between the end of the mounting flange of said outer frame member and the vertical flange of said inner frame member to accommodate walls of different thickneses.

5. The door assembly of claim 4 in which said outer frame has a transverse flange extending outwardly from said vertical flange and the wall within which it is mounted as an extension of said mounting flange for supporting a portion of said inner frame member and a door mounted therein.

* * * * *